US005772410A

United States Patent [19]

Chang

[11] Patent Number: 5,772,410

[45] Date of Patent: Jun. 30, 1998

[54] LINEAR COMPRESSOR WITH COMPACT MOTOR

[75] Inventor: Keun Sik Chang, Suwon, Rep. of Korea

[73] Assignee: Samsung Electronics Co., Ltd., Suwon, Rep. of Korea

[21] Appl. No.: 722,845

[22] Filed: Sep. 26, 1996

[30] Foreign Application Priority Data

Jan. 16, 1996 [KR] Rep. of Korea ..... 1996-716

[51] Int. Cl.[6] ..... F04B 17/03

[52] U.S. Cl. ..... 417/363; 417/372; 417/417

[58] Field of Search ..... 417/417, 363, 417/372; 310/54, 58, 12, 14, 15, 30

[56] References Cited

U.S. PATENT DOCUMENTS

| | | | |
|---|---|---|---|
| 4,027,211 | 5/1977 | Omura et al. | 417/417 |
| 4,416,594 | 11/1983 | Ichikawa | 417/372 |
| 4,421,464 | 12/1983 | Schmidt et al. | 417/417 |
| 4,632,645 | 12/1986 | Kawakami et al. | 417/417 |
| 5,275,542 | 1/1994 | Terauchi | 417/417 |
| 5,597,294 | 1/1997 | McGrath | 417/417 |

FOREIGN PATENT DOCUMENTS

| | | | |
|---|---|---|---|
| 2266932 | 11/1993 | United Kingdom | 417/417 |

*Primary Examiner*—Timothy Thorpe
*Assistant Examiner*—Peter G. Korytnyk
*Attorney, Agent, or Firm*—Burns, Doane, Swecker & Mathis, L.L.P.

[57] ABSTRACT

A linear compressor includes a casing, and a cylinder member suspended by springs from the casing. The cylinder member forms a compression chamber in which a piston is reciprocated by a linear motor. The motor includes a first stator situated inside of the piston, and a second stator situated opposite the first stator outside of the piston. The cylinder member comprises spaced apart first and second cylinder blocks with the second stator clamped therebetween. The first cylinder block contains the compression chamber, and the second cylinder block carries a hollow guide extending into the piston, with the first stator mounted on an outer surface of the guide. The piston includes an axial shaft reciprocally guided within the hollow guide. The piston carries a first magnet. A coil disposed between the first and second stators generates a magnetic field passing across the magnet to cause the piston to reciprocate. The cylinder member can be cooled by cooling fluid conducted through a cooling pipe wrapped around the cylinder member.

18 Claims, 5 Drawing Sheets

LINEAR COMPRESSOR WITH COMPACT MOTOR

FIELD OF THE INVENTION

The present invention relates to a compressor employing a linear motor.

BACKGROUND OF THE INVENTION

Compressors are commonly used for the compression processes of systems employing the refrigeration cycle. There are various types of the compressors and, particularly, reciprocating compressors are one of the most widely used types of them.

The reciprocating compressor which is installed in an enclosed container includes a rotary motor for generating rotating force, and a crank mechanism for converting a rotational motion of the motor into straight-line reciprocation. The reciprocating compressor takes a refrigerant in, compresses it, and pumps it out.

Such a reciprocating compressor employing the rotary motor, however, uses the crank mechanism for the purpose of switching the motion of the rotary motor to the straight-line reciprocating movement, and there is a great amount of mechanical energy lost because of mechanical friction between the moving parts of the reciprocating compressor. Besides, a lubricant oil is preferably used to lessen friction between a moving piston and a cylinder wall, and acts as an obstacle to the selection of a refrigerant that does not bring about depletion of the ozone layer.

Compressors employing linear motors and being driven without lubricating oils have been developed in order to overcome the above-mentioned problems. FIG. 5 depicts a conventional compressor employing a linear motor, i.e. a conventional linear compressor.

The conventional linear compressor has a piston 3 concentrically disposed in a compression chamber 2 formed in a cylinder block 1. The cylinder block 1 consists of an inner body 1*a* which forms the compression chamber 2, and an outer body 1*b* which encloses the inner body 1*a*.

A linear motor 4 is provided between the inner body 1*a* and the outer body 1*b*. The linear motor 4 includes a first stator 4*a* and a second stator 4*b* mounted to the outer and inner bodies 1*a*, 1*b*, respectively, and a coil 4*d* is placed between the first and second stators 4*a* and 4*b*. The piston 3 consists of a central part 3*a* and a flange 3*b* formed to be spaced from the central part 3*a*. The central part 3*a* of the piston 3 is inserted into the compression chamber 2, and the flange 3*b* is disposed between the inner body 1*a* and the outer body 1*b* of the cylinder block 1. A permanent magnet 4*c* constituting a part of the linear motor 3 is integrally mounted on the flange 3*b*, and moves up and down with the piston 3.

In the conventional linear compressor, the piston 3 is installed at the center of the linear compressor, and outside of the piston 3 are successively provided the inner body 1*a* of the cylinder block 1, the second stator 4*b*, the permanent magnet 4*c*, the coil 4*d*, the first stator 4*a*, and the outer body 1*b* of the cylinder block 1.

A plate spring 5 is placed on the bottom of the piston 3 and elastically supports the piston 3 so as to allow the piston 3 to move up and down.

As mentioned above, the conventional linear compressor includes the cylinder block 1 consisting of the inner body 1*a* and the outer body 1*b*, and the linear motor 4 disposed between the inner body 1*a* and the outer body 1*b* includes the first and second stators 4*a* and 4*b*, to thereby increase the overall size of the linear compressor.

The increased size of the linear compressor is of no advantage to an electric appliance using it. For instance, when such a conventional linear compressor is used for a refrigerator, it is difficult to install the compressor horizontally in the interior of the refrigerator. Also, the compressor occupies volume that could otherwise be used for the refrigerator and freezer compartments, and imposes on the arrangement of the freezer and refrigerator compartments.

The conventional linear motor 4 which is interposed between the inner body 1*a* and the outer body 1*b* of the cylinder block 1 is of a relatively large size to thereby take up much space in the linear compressor. Accordingly, the respective materials of the permanent magnet 4*c*, the first and second stators 4*a* and 4*b* and the coil 4*d* which constitute the linear motor 4 are large which increase the overall production costs and the loss of motive power owing to the coil resistance.

As discussed above, the conventional linear compressor has a relatively large size which requires much space, and there is no room for means (for example, cooling pipes) for dissipating frictional heat generated by the up-and-down movement of the piston 3 and heat produced by the linear motor 4.

SUMMARY OF THE INVENTION

Accordingly, the present invention has been devised to overcome the above-mentioned problems of the conventional art by introducing a linear compressor with an improved structure.

It is an object of the present invention to provide a linear compressor whose structure is improved so as to be of a smaller size and to be arranged in a horizontal direction.

It is another object of the present invention to provide a linear compressor in which a permanent magnet, stators and a coil constituting a linear motor are designed to be small in size in order to lower overall production costs, and the coil is reduced in length thereby minimizing the loss of motive power of the linear motor.

It is still another object of the present invention to provide a linear compressor in which the temperature and specific volume of a refrigerant can be reduced and whose overall functions can be enhanced by effectively cooling down the heated cylinder and the linear motor.

In order to achieve the above objects and advantages and in accordance with the purpose of the present invention, as embodied and broadly described, a linear compressor of the present invention includes a casing, a cylinder mounted in the casing which has a compression chamber, a piston disposed in the compression chamber, a linear motor allowing the piston to move up and down, and an elastic member elastically supporting the piston.

The linear motor has a first stator installed inside of the piston; a second stator formed in the cylinder to be oppositely disposed respective to the first stator; a coil formed between the first and second stators; and a magnet carried by the piston and creating a magnetic field between itself and the first and second stators by the use of a power source applied from the outside so as to cause the piston to move up and down. The cylinder is formed in the shape of a single cylinder.

The piston includes a head formed to close the lower part of the compression chamber; a piston extension part extending downward from the edge of the head to form a hollow space within the piston; and a piston shaft extending downward from the center of the hollow space. Besides, the cylinder includes cylinder blocks; a guide created within the hollow space to accommodate the piston shaft and to direct the up-and-down movement of the piston shaft; and a link connecting the cylinder blocks with the guide. The first stator is installed on the outer circumferential surface of the guide formed within the piston. The magnet is fixed on the piston extension part between the first and second stators. The magnet employed in the present invention is a permanent one.

The cylinder includes a first cylinder block and a second cylinder block that can be separated from each other, and the second stator of the linear motor is disposed between the first and second cylinder blocks. Suspension springs are provided between respective outer circumferential surfaces of the cylinder and inner circumferential surfaces of the casing. The elastic member is designed to be in plate shape and fixed to the bottom of the cylinder block, and the piston shaft extends through the guide which is fixed on its central portion.

The inventive compressor further includes a plurality of cooling pipes disposed around outer circumferential surfaces of the cylinder, spaced from each other at a predetermined distance. These cooling pipes are branched from a refrigerant tube passing through a condenser.

It is to be understood that both the foregoing general description and the following detailed description are exemplary and explanatory which are intended to provide further explanation of the invention as claimed.

BRIEF DESCRIPTION OF THE DRAWINGS

The above objects of the present invention will become more apparent upon consideration of the presently preferred embodiments of the present invention with reference to the attached drawings in which.

DESCRIPTION OF THE PREFERRED EMBODIMENTS

Preferred embodiments of the present invention will now be discussed in detail with reference to the accompanying drawings.

Figure 1:
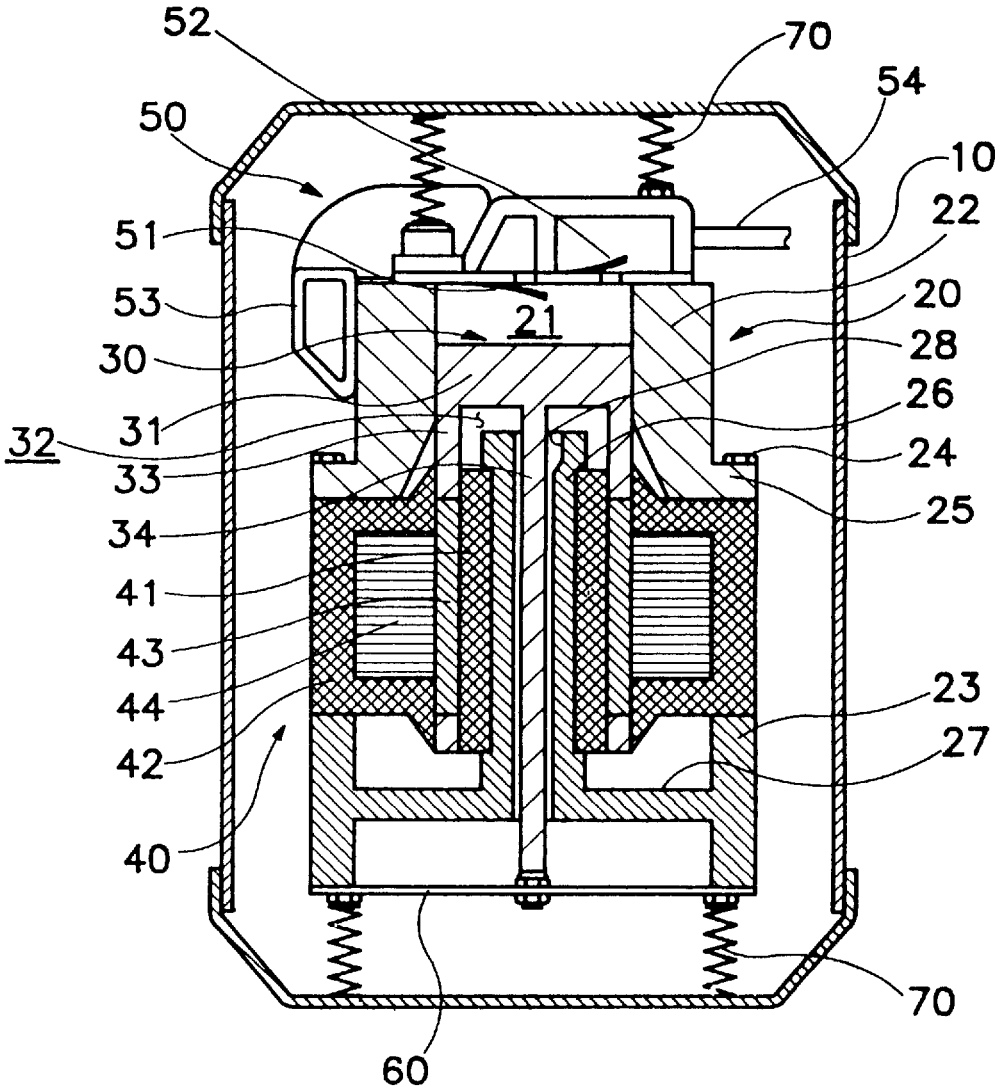
FIG. 1 is a sectional view of an upright linear compressor in accordance with a first preferred embodiment of the present invention.

Attention is first directed to FIG. 1 which illustrates a sectional view of an upright linear compressor in accordance with a first preferred embodiment of the present invention.

A cylinder head 20, a piston 30, and a linear motor 40 for driving the piston 30 are installed inside of a casing 10. A compression chamber 21 is created in the cylinder 20 and the piston 30 is disposed within this compression chamber 21. The lower part of the compression chamber 21 is closed by the piston 30, and its upper part is opened or closed by a valve assembly 50.

The cylinder 20 is placed in the casing 10 to be spaced from the inner circumferential surface of the casing 10, and consists of an upper cylinder block 22 and a lower cylinder block 23. Between these upper and lower cylinder blocks 22 and 23 is provided a second stator 42 that will be discussed later. The second stator 42 is fastened to the upper and lower cylinder blocks by the use of bolts 24. For such a fastening, a flange 25 is created on the lower part of the upper cylinder block 22. The bolts 24 pass through the flange 25 to join together the upper and lower cylinder blocks 22 and 23 and the second stator 42 disposed therebetween.

A guide 26 is defined by an inner portion of the lower cylinder block 23. The lower part of the guide 26 is integrally connected to the lower cylinder block 23 by a link 27, and its upper part extends to the inside of the upper cylinder block 22. The guide 26 includes a guide hole 28 axially extending so as to guide the up-and-down movement of a piston shaft 34 of the piston 30. This guide hole 28 is preferably designed to be of enough size enough to accommodate the piston shaft 34 of the piston 30.

Figure 5:
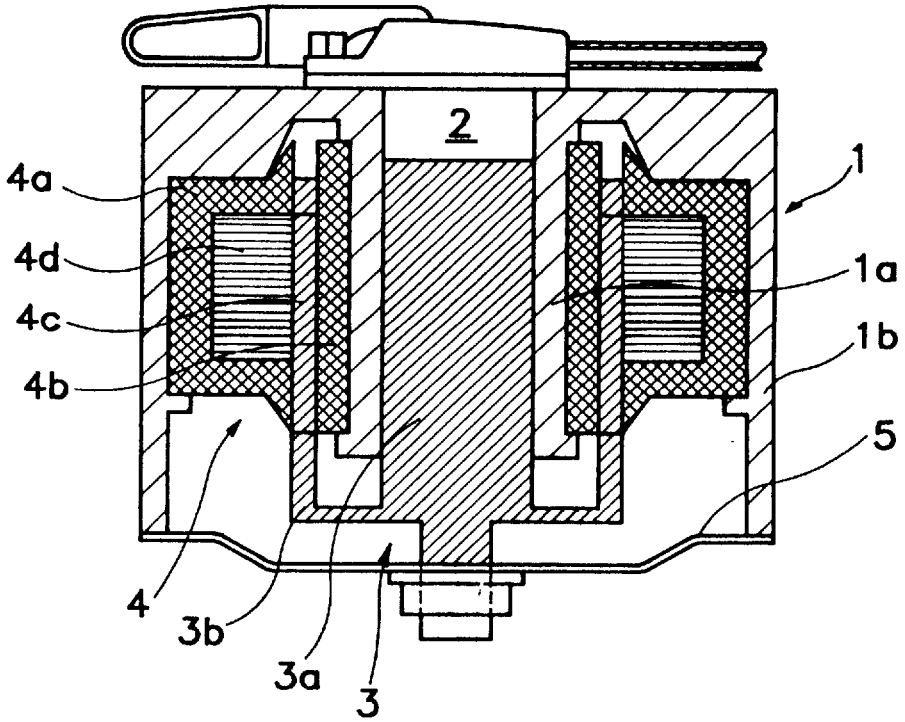
FIG.5 (PRIOR ART)
FIG. 5 is a sectional view of a conventional linear compressor.

The piston 30 which is placed inside of the upper cylinder block 22 consists of a disk-shaped head 31 disposed in the compression chamber 21, a piston extension part 33 extending downward from the edge of the head 31 and forming a hollow space 32 within the piston 30, and a piston shaft 34 extending downward from the center of the hollow space 32. The outside diameter of the piston 30 is either substantially similar to or slightly larger than that of the conventional piston 3 of FIG. 5.

The outer circumferential surface of the disk-shaped head 31 is flush with that of the piston extension part 33, and each of them makes an up-and-down movement along the inner circumference of the upper cylinder block 22. The piston shaft 34 is disposed to be concentric with the head 31 and the piston extension part 33, and moves up and down with the movement of the head 31 and the piston extension part 33. The piston shaft 34 has an upper part connected to the head 31 and a lower part joined to an elastic member 60, the shaft 34 passing through the guide 26 of the lower cylinder block 23.

The linear motor 40 includes a first stator 41 which is provided to the guide 26 of the lower cylinder block 23, the second stator 42 that is formed between the upper and lower cylinder blocks 22 and 23 to be oppositely disposed respective to the first stator 41, and a permanent magnet 43 which is placed between the first and second stators 41 and 42.

The first stator 41 is made up of a plurality of plates stacked circumferentially, and is either tightly fitted into the guide 26 or fixed thereto by the use of an auxiliary fastening member.

Likewise, the second stator 42 is composed of a plurality of plates stacked circumferentially, and is fixedly disposed to be spaced from the first stator 41 between the upper and lower cylinder blocks 22 and 23. It is preferable that the outer circumferential surface of the second stator 42 is disposed to be flush with that of the lower cylinder block 23.

The permanent magnet 43 is designed to be in a cylindrical shape, and is integrally connected to the piston extension part 33. A coil 44 is wound around the interior of the second stator 42. An external power source is applied to the coil 44, and electric current passing through the coil 44 creates a magnetic field between the magnet 43 and the first and second stators 41 and 42. An up-and-down force acts on the permanent magnet 43 that is magnetized in a radial direction. This force results from the supply of electricity from outside that changes direction with a predetermined supply frequency. Therefore, the piston 30 that is integrally with such a permanent magnet 43 compresses a refrigerant flowing into the compression chamber 21 during its upward movement, and then pumps out the compressed refrigerant.

The valve assembly 50 consists of an intake valve 51, an exhaust valve 52, a noise suppressor 53 disposed on the high section of the intake valve 51, and a discharge pipe 54 communicating with the exhaust valve 52. The discharge pipe 54 extends to the outside of the casing 10 to be connected to a condenser (not illustrated).

The elastic member 60 is installed under the lower part of the lower cylinder block 23 so as to elastically support the up-and-down movement of the piston 30 and to duplicate the movement as well. This elastic member 60 is formed of a plate spring, and its outermost portion is joined to the lower cylinder block 23 and its central portion is coupled with the piston shaft 34 of the piston 30.

This elastic member 60 may include a screw slot which is not illustrated in the drawing, so as to extend and contract adequately in response to the up-and-down movement of the piston 30. To maximize the up-and-down movement of the piston 30, the supply frequency of the external power source is set to be substantially the same as the natural oscillation frequency of the mass system consisting of the piston 30 and the elastic member 60 so that the piston 30 and the elastic member 60 can be resonated.

The cylinder 20, the linear motor 40 and the elastic member 60 are integrally coupled with one another, and are suspended by suspension springs 70 within the casing 10. The suspension springs 70 are provided in a space between the lower part of the lower cylinder block 23 and the bottom of the casing 10, and a space between the upper part of the valve assembly 50 and the ceiling of the casing 10.

Figure 2:
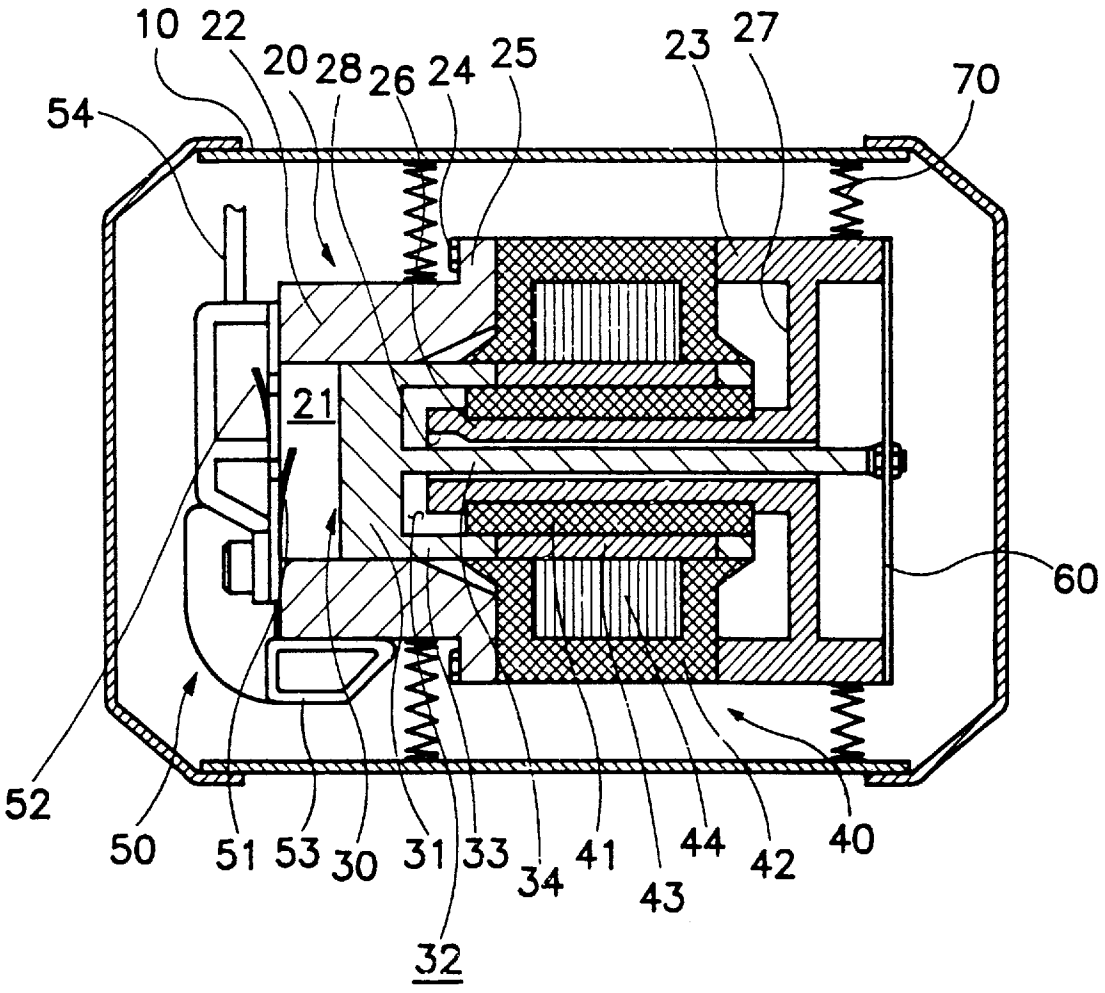
FIG. 2 is a sectional view of a horizontal version of the linear compressor in accordance with the first preferred embodiment of the present invention.

The above linear compressor of the present invention is an upright one having the components which are set in an up and down direction as shown in FIG. 1, but their components may instead be arranged in a horizontal direction, not upright, which is understood from FIG. 2 depicting a sectional view of such a horizontal linear compressor.

This horizontal linear compressor is of the same construction as that of the upright linear compressor of FIG. 1 except for its suspension springs disposed between both outer circumferential surfaces of the cylinder and inner circumferential surfaces of the casing.

The following description relates to the operation of the linear compressor of the present invention.

When power is applied to the coil 44, a magnetic field is created between the first and second stators 41 and 42 and the permanent magnet 43 by the electric current passing through the coil 44. The permanent magnet 43 is thereby magnetized in the radial direction, and is supplied with a reciprocal force of movability generated by the interaction between the first and second stators 41 and 42 and the permanent magnet 43. The force results from the electric current of the applied external power source that alternates with a predetermined frequency.

As the permanent magnet 43 is moved up and down by the force, the piston 30 that is integrally coupled with such a permanent magnet 43 also makes the up-and-down movement while being supported by the elastic member 60. At this point, the natural oscillation frequency of the mass system consisting of the piston 30 and the elastic member 60 is substantially similar to the frequency of the applied external power source, and the piston 30 and the elastic member 60 can be resonated in such a manner that the up-and-down movement of the piston 30 is maximized. The refrigerant is drawn in and compressed in the compression chamber 21 by the movement of the piston 30, and is then jetted out.

Figure 3:
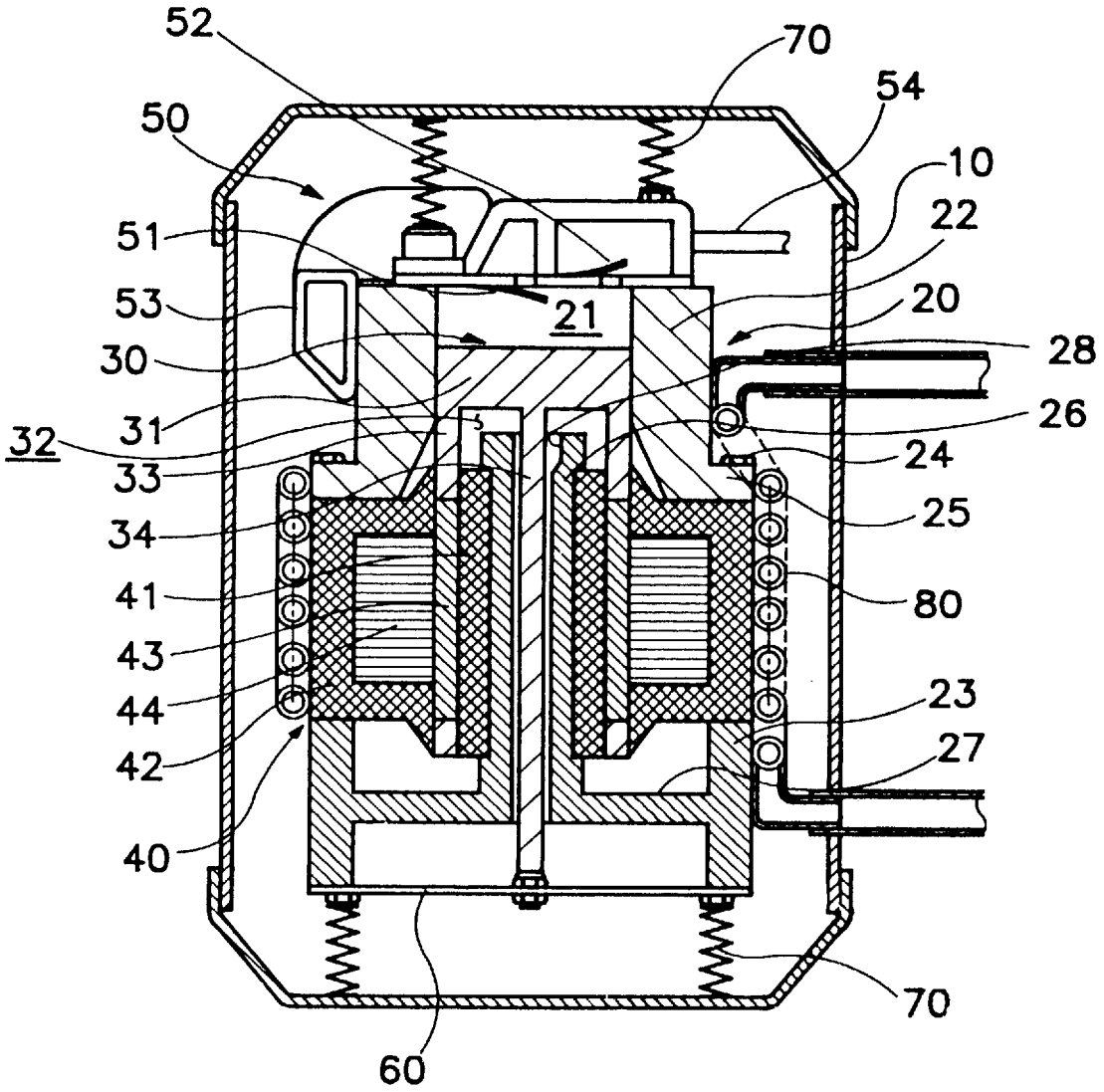
FIG. 3 is a sectional view of an upright linear compressor in accordance with a second preferred embodiment of the present invention.
Figure 4:
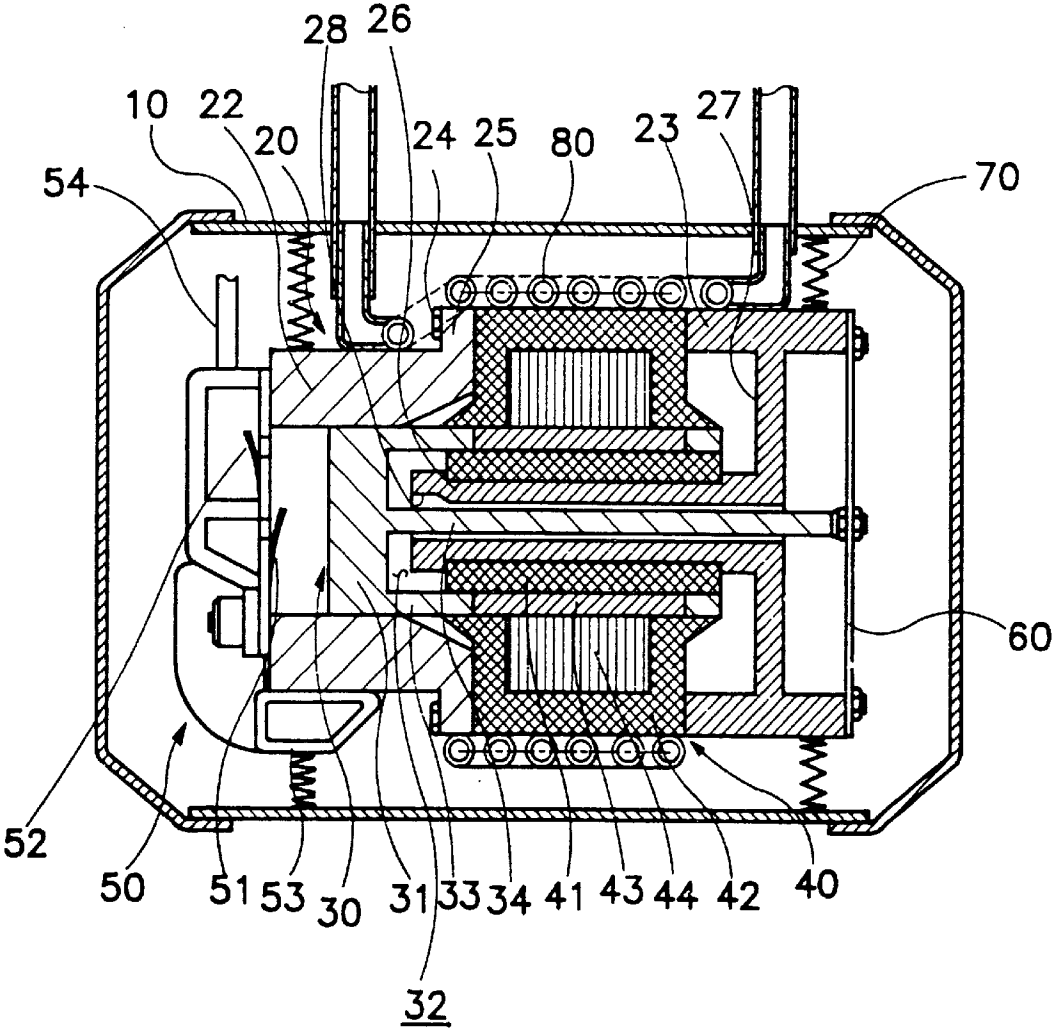
FIG. 4 is a sectional view of a horizontal version of the linear compressor in accordance with the second preferred embodiment of the present invention.

FIGS. 3 and 4 respectively depict an upright linear compressor and a horizontal one in accordance with a second preferred embodiment of the present invention.

The construction of the second preferred embodiment is similar to that of the first embodiment of the present invention, except that the second one further includes cooling pipes 80. Thus, redundant descriptions of features common to the first and second embodiments are omitted.

The cooling pipes 80 are branched from a refrigerant tube passing through a condenser (not illustrated) that forms the refrigeration cycle having the inventive linear compressor, and are introduced to the interior of a casing 10. These cooling pipes 80 are designed to surround the outer circumferential surfaces of an upper cylinder block 22 and a second stator 42. They may be disposed around a lower cylinder block 23, if circumstances require.

As a part of the refrigerant which is refrigerated through the condenser passes through the cooling pipes 80, the upper cylinder block 22 and the second stator 42 are cooled down. Accordingly, the specific volume of the refrigerant is decreased by dropping the temperatures of a piston 30 and a compression chamber 21, and the linear motor 40 is also cooled down to thereby enhance the linear motor's function in such a manner that the overall efficiency of the linear compressor can be increased.

Liquids such as water provided from a secondary device may serve as the refrigerant circulating through the cooling pipes 80. It is possible to provide the cooling pipes 80 to the linear compressor because the respective cylinder 20, the piston 30 and the linear motor 40 are improved in construction according to the present invention to be of an outside diameter and size smaller than the conventional one.

The effects and advantages of the present invention are now described as follows.

Firstly, the cylinder of the inventive compressor is not of dual structure but of a compact one. As discussed above, the cylinder is designed to have an upper cylinder block and a lower cylinder one, and the linear motor is provided between these upper and lower cylinder blocks. The piston that is disposed to be movable up and down in the cylinder has a hollow space inside, and the first stator is disposed in this hollow space in such a manner that the linear compressor can be reduced in size thereby allowing the compressor to be arranged in a horizontal direction.

Secondly, when the small-sized and horizontally-arranged linear compressor of the present invention is employed in an electric appliance such as a refrigerator, the horizontal installation may ensure a significant increase in the effective space of the interior of the refrigerator, which facilitates installation of other necessary components in the secured space.

Thirdly, the size of the linear motor may be decreased by mounting the first stator within the piston that is mounted inside of the cylinder, which causes a lowering in the overall production costs and reduction in the consumption of motive power owing to the coil's resistance to thereby enhance the efficiency of the linear motor.

Fourthly, by installing a plurality of the cooling pipes in the extra free space that results from the decrease in the size of the linear motor, heat produced by the drive of the linear motor and the reciprocating movement of the piston can be effectively reduced so that the specific volume of the refrigerant can be decreased at lower temperature and a drop in the efficiency of the linear motor due to generation of the heat may be prevented. Therefore, the present invention offers an enhancement in the overall functions of the linear motor and linear compressor as well.

While the invention has been described in conjunction with specific embodiments thereof, it is evident that several alternatives, modifications, and variations will be apparent to those skilled in the art in light of the foregoing description. Accordingly, it is intended to embrace all such alternatives, modifications, and variations as fall within the spirit and broad scope of the following claims.

What is claimed is:

1. A linear compressor comprising:

a casing;

a cylinder member mounted in the casing and forming a cylindrical compression chamber having an axis;

a piston including a piston head disposed for reciprocation in the compression chamber along the axis for compressing a fluid;

valves for admitting uncompressed fluid to the compression chamber, and exhausting compressed fluid therefrom;

an elastic member elastically supporting the piston; and a linear motor for causing the piston to reciprocate, the motor including:

a magnet fixed to the piston, a first stator disposed inside of the piston, a second stator disposed outside of the piston and opposite the first stator, with the magnet situated between the first and second stators, and a coil disposed between the first and second stators for generating a magnetic field between the first and second stators and across the magnet to cause the magnet and piston to reciprocate.

2. The linear compressor according to claim 1 wherein the piston includes an axial extension part extending from the piston head and forming a hollow space in which the first stator is disposed, and a piston shaft extending from the piston head along the axis and within the hollow space and passing through the first stator.

3. The linear compressor according to claim 2 wherein the cylinder member includes a hollow guide extending within the hollow space, with the piston shaft mounted for reciprocation within the guide.

4. The linear compressor according to claim 3 wherein the guide passes through the first stator, and the first stator is mounted on the guide.

5. The linear compressor according to claim 3 wherein the cylinder member comprises first and second cylinder blocks spaced axially apart by the second stator which is disposed therebetween; the first cylinder block forming the compression chamber; the guide being a part of the second cylinder block.

6. The linear compressor according to claim 5, the elastic member being plate-shaped and fixed to the second cylinder block, the piston shaft being fixed to the elastic member.

7. The linear compressor according to claim 2 wherein the magnet is affixed to the extension part of the piston.

8. The linear compressor according to claim 1 wherein the cylinder member comprises first and second cylinder blocks spaced axially apart by the second stator which is disposed therebetween.

9. The linear compressor according to claim 1 including suspension springs suspending the cylinder member from the casing.

10. The linear compressor according to claim 1 wherein the axis is vertically oriented.

11. The linear compressor according to claim 1 wherein the axis is horizontally oriented.

12. The linear compressor according to claim 1, further including a cooling pipe disposed around an outer circumferential surface of the cylinder member for conducting a cooling fluid.

13. The linear compressor according to claim 12 wherein the cylinder member comprises a first cylinder block containing the compression chamber, and a second cylinder block spaced axially from the first cylinder block; the second stator disposed in the space; the first and second cylinder blocks being secured together by bolts passing through the second stator, the cooling pipe extending around the first cylinder block and the second stator.

14. A linear compressor comprising a casing, a cylinder member mounted in the casing and forming a compression chamber, a piston disposed in the compression chamber, a linear motor for reciprocating the piston along an axis within the compression chamber to compress a fluid, and an elastic member elastically supporting the piston, the improvement wherein:

the piston comprises:

a head formed disposed with the compression chamber, a piston extension part extending in an axial direction from the head and forming a hollow space, and a piston shaft extending from the head along the axis and within the hollow space;

the cylinder member comprising:

a first cylinder block forming the compressing cylinder, a second cylinder block spaced from the first cylinder block; and a hollow guide joined to the second cylinder block and a receiving the piston shaft to guide the reciprocal movement of the piston shaft;

the linear motor comprising:

a magnet fixed to the piston, a first stator installed on an outer circumferential surface of the guide inside of the piston, a second stator disposed in the space between the first and second cylinder blocks opposite the first stator, and a coil disposed between the first and second stators for generating a magnetic field between the first and second stators and across the magnet to cause the magnet and piston to reciprocate.

15. The linear compressor as set forth in claim 14, wherein the magnet is a permanent magnet fixed to the piston extension part.

16. The linear compressor as set forth in claim 14, wherein the first cylinder block is joined to the second cylinder block by bolts passing through the second stator.

17. The linear compressor as set forth in claim 14, wherein the elastic member is plate-shaped and fixed to the second cylinder block, the piston shaft fixed to a central portion of the elastic member.

18. The linear compressor as set forth in claim 14, wherein the cylinder member is suspended from the casing by suspension springs extending therebetween.

* * * * *